United States Patent [19]

Herrmann et al.

[11] 4,301,225

[45] Nov. 17, 1981

[54] ALCOHOL SOLUBLE, ORGANIC PHOTOCONDUCTOR CONTAINING POLYMERIC PROTECTIVE LAYER ON ELECTROPHOTOGRAPHIC MATERIAL

[75] Inventors: Heinz Herrmann; Detlef Winkelmann, both of Wiesbaden, Fed. Rep. of Germany

[73] Assignee: Hoechst Aktiengesellschaft, Fed. Rep. of Germany

[21] Appl. No.: 97,456

[22] Filed: Nov. 26, 1979

Related U.S. Application Data

[63] Continuation of Ser. No. 628,498, Nov. 3, 1975, abandoned.

[30] Foreign Application Priority Data

Nov. 6, 1974 [DE] Fed. Rep. of Germany ..... 2452623

[51] Int. Cl.[3] ..... G03G 5/06; G03G 5/14

[52] U.S. Cl. ..... 430/66; 430/961; 430/67; 430/132; 430/79

[58] Field of Search ..... 430/132, 66, 67, 961, 430/62

[56] References Cited

U.S. PATENT DOCUMENTS

| | | | |
|---|---|---|---|
| 3,871,882 | 3/1975 | Wiedemann | 430/67 |
| 3,904,407 | 9/1975 | Regensberger et al. | 430/67 |
| 3,953,207 | 3/1976 | Horgan | 430/67 |

*Primary Examiner*—John D. Welsh

*Attorney, Agent, or Firm*—James E. Bryan

[57] ABSTRACT

This invention relates to an electrophotographic material comprising an electrically conductive support, a photoconductive layer based on at least one organic photoconductive substance on the support, and a protective layer composed of at least one polymeric substance covering the photoconductive layer, said protective layer containing at least one photoconductive organic compound in a quantity of about 0.1 to 30 percent by weight, based on the weight of polymeric substance.

2 Claims, No Drawings

ALCOHOL SOLUBLE, ORGANIC PHOTOCONDUCTOR CONTAINING POLYMERIC PROTECTIVE LAYER ON ELECTROPHOTOGRAPHIC MATERIAL

This is a continuation of application Ser. No. 628,498 filed Nov. 3, 1975, now abandoned.

The present invention relates to an electrophotographic material which is composed of an electrically conductive support, a photoconductive layer, based on organic photoconductive substances, on the support, and a protective layer covering the photoconductive layer and comprising polymeric material.

From German Pat. Nos. 1,068,115, 1,131,988, 1,133,976, and 1,180,242, as well as from German Auslegeschrift No. 1,572,347, electrophotographic recording materials are known in which the photoconductive layer contains organic photoconductors. Layers containing organic photoconductors have the advantage, compared to layers containing inorganic photoconductors, e.g. selenium, that they are more elastic and more flexible and therefore may be used in the form of webs without major difficulties, even if they are rolled and have a relatively small diameter.

In the electrophotographic process for the production of copies described in U.S. Pat. No. 2,297,691, and presently often used, a thorough cleaning of the layer of photoconductor is always necessary after the transfer of the dry developed image from the layer of photoconductor onto the copy sheet. This cleaning is usually carried out by brushing or wiping the photoconductive layer with suitable brushes or tissues. In the case of copying machines operated with liquid developers, the effect of the mechanical cleaning is often increased by using a liquid cleaner as well. Apart from these cleaning operations, the photoconductive layer is subjected to other damaging influences, also. It is subjected, for example, to the effect of the developer and furthermore, in the case of a development with liquid developer, to the effect of the developer liquid. It is also subjected to the ionized air produced in the charging station. It is apparent that the necessary cleaning processes and the other influences mentioned, particularly in the case of organic photoconductive layers, lead sooner or later to impairment or even mechanical damage of the photoconductive layer and, as a consequence, shorten the life of these photoconductor layers.

It is known from U.S. Pat. Nos. 2,860,048, and 3,617,265, and from German Offenlegungsschrift No. 1,572,368, to protect photoconductive layers from impairing operations and influences by coating them with polymeric substances. The coatings necessarily must be relatively thick.However, this has the disadvantage that these protective layers prevent a sufficient discharge of the photoconductive layer during imagewise exposure. The relatively high residual charge which thus remains leads to copies having a reduced contrast, and to scumming.

Therefore, it is the object of the present invention to eliminate the above-mentioned disadvantages of the otherwise useful protective layers composed of polymeric substances and to propose an electrophotographic material in which the organic photoconductive layer is provided with a coating of polymeric materials protecting it from mechanical damage or other adverse influences, where the coating, however, does not appreciably interfere with operation of the photoconductive layer.

According to the invention this object is achieved by an electrophotographic material which is composed of an electrically conductive support, a photoconductive layer, based on organic photoconductive substances, on the support, and a protective layer composed of polymeric substances and covering the photoconductive layer. The protective layer contains at least one photoconductive organic compound in a quantity of 0.1 to 30 percent by weight, based on the weight of polymeric substance. According to a preferred embodiment of the invention, the quantity of photoconductive organic compound in the protective layer is 1 to 20 percent by weight, based on the weight of polymeric substance.

Various polymeric substances may be used for the protective layer to be applied to the organic photoconductive layer according to the invention, preferably the polymers composed of organic monomers which have a high mechanical rigidity, a good transparency (for the copying light) and a conductivity which can be influenced only slightly by the humidity of the atmosphere. Suitable polymeric substances are, for example, thermoplastic materials such as polymers of vinyl chloride, vinylidene chloride, vinyl esters such as vinyl acetate, acrylic acid esters, methacrylic acid esters or styrene, as well as copolymers of these monomers themselves or with other suitable copolymerizable monomers, such as acrylonitrile, butadiene, crotonic acid or maleic acid. Copolymers are, among others, those of vinyl acetate-crotonic acid, vinyl acetate-maleic acid, styrene-maleic acid and acrylonitrile-butadiene-styrene.

Other suitable polymeric substances are condensation resins and addition resins, for example oil-free alkyd resins, maleinate resins, phenol resins such as phenol-formaldehyde resins, amine resins such as urea-formaldehyde resins or melamine-formaldehyde resins, polyvinyl acetals such as polyvinylbutyral, polyurethanes, epoxide esters as well as cellulose ethyl ethers and cellulose esters such as nitrocellulose soluble in alcohol, cellulose propionate or cellulose acetate butyrate. Particularly suitable polymeric substances are, combined with the preferably applied photoconductive layer of polyvinyl-carbazole-2,4,7-trinitrofluorenone, polyvinyl acetate soluble in lower alcohols, polyvinyl butyral and especially nitrocellulose soluble in lower alcohols.

Basically, all organic photoconductors may be used as photoconductive organic compounds according to the invention. However, they should be compatible with the polymeric substance so that they do not render the polymeric protective layer turbid if used in the quantity to be applied according to the invention. For this reason, especially monomeric photoconductive compounds are used, as they are described in, for example, German Auslegeschriften Nos. 1,058,836, 1,060,260, 1,060,712, 1,060,713, 1,060,714, 1,070,923, 1,099,846, 1,101,145, 1,105,713, 1,105,714, 1,106,599, 1,109,032, 1,110,518, 1,120,875, 1,137,625, and 1,193,363, as well as photoconductive organic dyes and leuco dyes. This enumeration does not represent a limitation, but emphasizes the very high number of substances which may be used according to the invention.

The protective layers according to the invention are suitably applied to the organic photoconductive layer in such a manner that a solution or dispersion is prepared from a polymeric substance or a mixture of polymeric substances compatible with each other and one or more organic photoconductors in a quantity of 0.1 to 30 percent by weight, preferably in a quantity of 1 to 20 percent by weight, based on the weight of polymeric substance, a process during which it should be ensured that the photoconductive organic substance is present in a dissolved form. The solution or dispersion is then used for coating the organic photoconductive layer. The thickness of the layer is about 10 to about 20 μm, the layer being on a support common in electrophotography, e.g. on a metal web or on a plastic film made conductive. The coating is carried out by means of one of the known methods, for example pouring, spreading, spraying or dipping. Then, the liquid solution or dispersion is evaporated. The continuous protective layer thus produced on the organic photoconductive layer has a uniform thickness of 0.5 to 10 μm, preferably of 1 to 5 μm. According to the invention, protective layers are preferably used which are composed of polymeric substances soluble in lower alcohols and photoconductive organic compounds soluble in these alcohols.

For the production of the solutions or dispersions of one or several polymeric substances and one or several organic photoconductors, water as well as an organic liquid or mixtures of both may be used. The choice should be such that the solution agent or dispersion agent does not damage the organic photoconductive layer and that it is ensured that the photoconductive organic substance dissolves. For example, if photoconductive layers composed of polyvinyl carbazole/2,4,7-trinitrofluorenone are coated, water, aliphatic hydrocarbons or lower alcohols having 1 to 4 carbon atoms may be used. Preferably, the lower alcohols, such as methanol, ethanol, propanol or butanol are used, since they usually effect the solubility of organic photoconductors. Suitable polymers soluble in these alcohols are the polyacrylates, polyvinyl acetals, polyvinyl acetates, cellulose nitrates, cellulose acetate butyrates, cellulose propionates, ethyl celluloses and the various copolymers which contain hydroxyl groups or carboxyl groups. Monomers may form part of the structure of the copolymers which are insoluble in alcohol in the form of their homopolymers, for example vinyl chloride, vinylidene chloride, styrene, alkyl styrene and acrylic acid alkyl ester. Polymers having a high molecular weight are preferred, since they have the highest abrasion resistance.

Among the condensation and addition resins, also, there are suitable polymers soluble in alcohol, for example among the rosin derivatives, the oil-free alkyds, the maleinate resins, the phenol resins, the ketone resins, the urea resins, the melamine resins and similar resins. The last-mentioned amine resins must be cross-linked by heating or by adding acid catalysts, for example p-toluene sulfonic acid, in order to form an abrasion-proof protective film.

Useful polymers soluble in benzene are, for example, the alkyd resins containing oil, the acrylated alkyd resins, the polyurethane alkyd resins and the epoxide ester resins. If the photoconductive material is used in a copying process operating with the liquid developer, siccatives must be added in the case of resins soluble in benzene, so that the layers become insoluble in the developer liquid (aliphatic solvent). The application of resins soluble in benzene is limited by the lack of photoconductors soluble in benzene.

Lustering agents, slipping agents, leveling agents and/or plasticizers may be added to the coating solutions or dispersions, also in order to obtain glossy surfaces and improved mechanical properties of the protective layers.

The suitable quantity of polymeric substance, of organic photoconductive substance and, if the occasion arises, of additions as they are described above, in the coating solutions or dispersions is, depending on the method of coating, 1 to 20 percent by weight, preferably 2 to 8 percent by weight.

The electrophotographic material according to the invention has a high abrasion resistance and wear resistance. In spite of the protective layer, the material according to the invention reacts almost in the same manner as a corresponding material without a protective layer. The protective layer applied to the organic photoconductive layer according to the invention does not cause any significant difficulties in the electrophotographic copying process and has no adverse effect on the quality of the copies.

Surprisingly, the layers according to the invention increase the light-sensitivity of the unprotected organic photoconductive layer. This effect renders possible a higher copying speed or a reduction in light energy in the copying machines.

Unexpectedly it was also realized that by adding a photoconductor to polymeric protective layers an increased charge can be obtained in many cases. This effect makes possible a reduction of the thickness of the photoconductive layer and thus a reduction in cost.

The following examples further illustrate the invention. The treatment is applied to an electrophotographic element composed of a support of a polyester film (thickness 75 μm), a thin (thickness 0.1 μm) aluminum layer, and a photoconductive layer on the support having a thickness of 12 μm and composed of polyvinyl carbazole/2,4,7-trinitro-9-fluorenone (molar ratio 1:1). The production of such layers is described for example, in German Auslegeschrift No. 1,572,347. This electrophotographic element is provided with a protective layer according to the invention.

EXAMPLE 1

A solution of 3 g of polyvinyl acetate (molecular weight 1 million) and 0.3 g of 2,5-bis(p-diethylamino phenyl)-oxdiazole-1,3,4, in 100 ml of methanol is applied, by means of a plate whirler, to the photoconductive layer composed of polyvinyl carbazole/2,4,7-trinitro-fluorenone, and dried. The protective layer thus produced has a thickness of 2 μm.

In the following examples the coating method of Example 1 is employed.

EXAMPLE 2

The coating solution is composed of 3 g of polyvinyl acetate (molecular weight 1 million), 0.06 g of Thioflavin TCN extra (C.I. 49,005) and 100 ml of methanol. The protective layer weighs 2.5 g per $m^2$ after drying.

EXAMPLE 3

The coating solution is composed of 3 g of polyvinyl acetate (molecular weight 1 million), 0.45 g of 2,5-bis(p-diethylaminophenyl)-triazole-1,3,4, 100 ml of methanol, 0.3 ml of lubricant based on silicone (lubricant Z 127 of Messrs. Wacker-Chemie GmbH, München). The protective layer has a thickness of 3 μm.

EXAMPLE 4

The protection lacquer is composed of 3 g of polyvinyl acetate (molecular weight 1 million), 0.45 g of 2(p-aminophenyl)-5(p-dipropyl aminophenyl)-thiadiazole-1,3,4, 100 ml of methanol and 0.2 ml of lubricant Z 127. The thickness of the film is 2 μm.

EXAMPLE 5

The protective lacquer is composed of 3 g of polyvinyl acetate (molecular weight 1 million), 0.45 g of 2-vinyl-4(o-chlorophenyl)-5(p-diethyl aminophenyl)-oxazole-1,3, 100 , ml of methanol, and 0.1 ml of lubricant Z 127. The thickness of the film is 2 μm.

EXAMPLE 6

The protective lacquer is composed of 3 g of polyvinyl acetate (molecular weight 1 million), 0.45 g of leucomalachite green, 100 ml of methanol, and 0.3 ml of lubricant Z 127. The thickness of the layer is 2 μm.

EXAMPLE 7

The protective lacquer is composed of 10 g of oil-free alkyd having a melting point of 110° to 120° C. (according to Kofler), an acid number of 180 to 200 and a dye number of from 1 to 2, 1.5 g of 2,5-bis(p-diethylaminophenyl)-oxdiazole-1,3,4, and 100 ml of ethanol. The weight of the layer is 3 g per $m^2$.

EXAMPLE 8

The protective lacquer is composed of 5 g of polyvinyl butyral having an acetal content of 70%, the viscosity of the 5 percent by weight butanolic solution being from 20 to 30 cP (according to Höppler), 1 g of 2,5-bis(p-diethyl aminophenyl)-oxdiazole-1,3,4, and 100 ml of ethanol. The weight of the layer is 2 g per $m^2$.

EXAMPLE 9

To the side to be coated of a photoconductive film composed of a polyester support, an intermediate layer of aluminum and a layer of polyvinyl carbazole/TNF-photoconductor, the following lacquer is applied in a coating machine: 46 g of nitrocellulose (standard type 23 A) (wetted with 35% of butanol) soluble in alcohol, 9 g of castor oil, 4.5 g of 2,5-bis(p-diethyl aminophenyl)-oxdiazole-1,3,4, 1000 ml of methanol, 400 ml of n-butanol, and 2 ml of lubricant Z 127. The weight of the layer is 2 g per $m^2$ after drying. A comparison layer is produced which has the same thickness but a lacquer free from photoconductor.

EXAMPLE 10

A drum of copying machine which is provided with a photoconductive layer of polyvinyl carbazole/TNF is lacquered, according to the dipping process, with a solution of 67.5 g of nitrocellulose (standard type 23 A) (wetted with 35% of butanol), 17.6 g of castor oil, 6.6 g of 2.5-bis(p-diethyl aminophenyl)-oxdiazole-1,3,4, 1000 ml of methanol, 400 ml of butanol, and 1 ml of lubricant Z 127. After drying the lacquer, the thickness of the protective film is 1.8 μm. The drum produced excellent copies in the copying machine. Its working life was prolonged by about 400% relative to a drum without a protective layer. A comparison drum having a protective layer free from photoconductor had an increased residual charge and the copies were no longer free of scum, if the relative humidity of the atmosphere was below 40%.

The table below shows some properties of the electrophotographic material obtained according to the Examples which are important in the copying process. For reasons of comparison, the table also gives figures which are obtained in the case of an unprotected photoconductive layer and a photoconductive layer provided with a corresponding protective layer, however, without the photoconductive organic compound.

TABLE

| Example | Protective layer of polymer | Percentage of photoconductor added | Photoconductivity* T/2(sec) | $U_o$(V) | $U_R$(V) | Abrasion resistance |
|---|---|---|---|---|---|---|
| — | — | — | 1.3 | 850 | 20 | little |
| 1-6 | polyvinyl acetate | — | 1.55 | 1030 | 120 | very good |
| 1 | polyvinyl acetate | 10% of oxdiazole derivative | 1.15 | 1050 | 50 | very good |
| 2 | polyvinyl acetate | 2% of Thioflavin TCN | 1.15 | 1030 | 40 | very good |
| 3 | polyvinyl acetate | 15% of triazole derivative | 1.15 | 1000 | 25 | very good |
| 4 | polyvinyl acetate | 15% of thiadiazole derivative | 1.15 | 1000 | 30 | very good |
| 5 | polyvinyl acetate | 15% of vinyloxazole derivative | 1.2 | 1050 | 30 | very good |
| 6 | polyvinyl acetate | 15% of leucomalachite green | 1.2 | 1050 | 30 | very good |
| 7 | oil-free alkyd | — | 1.4 | 880 | 20 | good |
| 7 | oil-free alkyd | 15% of oxdiazole derivative | 1.2 | 950 | 12 | good |
| 8 | polyvinyl butyral | — | 1.4 | 1050 | 150 | good-very good |
| 8 | polyvinyl butyral | 20% of oxdiazole derivative | 1.15 | 1050 | 35 | good-very good |
| 9 | nitrocellulose | — | 1.5 | 870 | 25 | very good |
| 9 | nitrocellulose | 15% of oxdiazole deriva- | 1.3 | 950 | 20 | very good |

TABLE-continued

| Example | Protective layer of polymer | Percentage of photoconductor added | Photoconductivity* T/2(sec) | $U_o$(V) | $U_R$(V) | Abrasion resistance |
|---|---|---|---|---|---|---|
| | | tive | | | | |

*measured in a Dyntest 90 apparatus (manufactured by ECE-GmbH, Giessen) with a quantity of light of 3.0$\mu$W/cm$^2$.
T/2 = half-time of the light discharge;
$U_o$ = maximum charge;
$U_R$ = residual charge after light discharge.

It will be obvious to those skilled in the art that many modifications may be made within the scope of the present invention without departing from the spirit thereof, and the invention includes all such modifications.

What is claimed is:

1. An electrophotographic material consisting essentially of an electrically conductive support, a photoconductive layer containing at least one organic photoconductive substance on said conductive support, and a protective layer covering said photoconductive layer and being composed of at least one polymeric substance selected from the group consisting of polyvinyl acetate, polyvinyl butyral and nitrocellulose, said polymeric substance being soluble in a lower alcohol selected from the group consisting of methanol, ethanol, propanol, butanol, and mixtures thereof, said protective layer containing at least one photoconductive organic compound being soluble in said lower alcohol in a total quantity of about 1 to 20 percent by weight based on the weight of the polymeric substance and having a thickness of 1 to 5 $\mu$m.

2. An electrophotographic material according to claim 1 in which the polymeric substance of the protective layer is nitrocellulose soluble in a lower alcohol selected from the group consisting of methanol, ethanol, propanol, butanol, and mixtures thereof.

* * * * *